United States Patent [19]

Brouwer et al.

[11] Patent Number: 5,072,889

[45] Date of Patent: Dec. 17, 1991

[54] TAKE-UP MECHANISM

[76] Inventors: Charles W. Brouwer, 4206 Tallwood Dr., Greensboro, N.C. 27410; Larry C. Cowan, R.R. #1 - Box 112C, Hickory Grove, S.C. 29717

[21] Appl. No.: 60,482

[22] Filed: Jun. 11, 1987

[51] Int. Cl.[5] ..... B65H 54/20; B65H 59/38

[52] U.S. Cl. ..... 242/35.5 R; 242/45

[58] Field of Search ..... 242/35.5 R, 45, 18 R

[56] References Cited

U.S. PATENT DOCUMENTS

| | | | |
|---|---|---|---|
| 3,565,355 | 2/1971 | Schippers et al. | 242/35.5 R X |
| 3,685,755 | 8/1972 | King et al. | 242/45 |
| 3,830,440 | 8/1974 | Bense | 242/35.5 R |
| 4,184,646 | 1/1980 | Seney | 242/45 |
| 4,518,126 | 5/1985 | Marshall | 242/35.5 R X |

FOREIGN PATENT DOCUMENTS

| | | | |
|---|---|---|---|
| 2952400 | 7/1981 | Fed. Rep. of Germany | 242/35.5 R |

*Primary Examiner*—Stanley N. Gilreath
*Attorney, Agent, or Firm*—Burnett W. Norton

[57] ABSTRACT

A take-up mechanism for simultaneously winding a plurality of yarns, tapes, or other strands on a plurality of take-up spindles is described. The mechanism comprises a support unit, a plurality of yarn take-up spindles positioned in substantially vertical alignment on the support unit, and a motor or the like in cooperation with the take-up spindles for driving separately each of the plurality of spindles. A compensator arm assembly comprising a plurality of compensator arms with each having a guide roll is positioned in substantially vertical alignment relative to the take-up spindles, with each of the compensator arms of the assembly individually controlling the speed of the drive motor for a take-up spindle. The plurality of yarn strands are fed to the compensator arm guide rolls at an angle of at least 60 degrees and no greater than 90 degrees. The take-up mechanism can be arranged in a compact manner which is of critical concern in a factory.

1 Claim, 3 Drawing Sheets

TAKE-UP MECHANISM

FIELD OF INVENTION

This invention relates to new and useful improvements in a take-up mechanism for controlling the winding speed of a strand being wound onto a yarn package such as a spool or tube positioned on a take-up spindle.

In this specification the term "strand" is employed in a general sense to relate to all kinds of elongated strandular materials including yarns, fibers, tapes, filaments, and the like.

BACKGROUND OF INVENTION

Take-up machines wherein a strand being wound advances from overhead guide rolls and around a compensator wheel with the tension of the strand loop on the compensator wheel controlling the position of a support arm are well known. In such machines the position of the support arm acts to control the speed of a motor rotating the winding mechanism for effecting winding of the strand. In the known devices, the mounting arm for the compensator wheel is pivotally mounted for movement about a fixed axis of rotation of the compensator wheel with a total angle of wrap around a guide roll and compensator wheel being about 270 degrees. With such devices it is the general practice to incorporate the compensator integral with the take-up spindles. See, for example, German Patent No. DE 2,952,400 and U.S. Pat. No. 4,518,126.

Moreover, in order to obtain the proper fan angle (as the term is used herein, "fan angle" is the angle at the spindle guide roll as a yarn traverses from one end of a spindle containing a take-up spool or tube to the other end) for the strand with respect to the take-up spool or tube, it is generally necessary to utilize a substantial fan length, i.e., the distance between compensator wheel and the take-up spindle is substantial. In modern plants where space is limited, it is desirable to reduce the amount of space necessary for a take-up mechanism so that a greater number of take-up units can be located in a given space. Accordingly, various alternative take-up mechanisms have been suggested such as in the aforesaid U.S. Pat. No. 4,518,126 where a compensator wheel unit includes a mounting arm, a support mounted on the arm for pivotal movement about a first axis which is fixed relative to the mounting arm, and a compensator wheel carried by the support for rotation relative to the support and for pivoting with the support along the fixed axis. The winding speed is controlled by the tension of the strand loop through a control device. U.S. Pat. No. 3,565,355 discloses a take-up device embodying superimposed decks of winding units or heads with individual speed controls and individual yarn feeds thereto from over head. The thread loops pass across dancer arms which function as speed control sensors for the winding units. In this device the supply of filaments being fed from the yarn supply are split with part passing over one dancer arm and a part passing over the second dancer arm to the take-up package.

SUMMARY OF THE INVENTION

In accordance with the present invention there is provided a take-up mechanism wherein a plurality of take-up spindles are positioned in substantial vertical alignment on a support unit. A drive means such as an electric motor is designed into the mechanism to drive separately each of the plurality of take-up spindles. A compensator arm assembly which comprises a plurality of compensator arms equal in number to the number of spindles with each arm having a compensator wheel or guide roll is positioned in substantial vertical alignment relative to the take-up spindle. A yarn strand is fed over the guide roll on the compensator arm at an angle of wrap of at least 60 degrees and no greater than about 90 degrees for take-up on the plurality of spindles. Each of the compensator arms of the compensator arm assembly individually controls the speed of the drive means for its take-up spindle receiving the yarn strand passing over the compensator arm guide roll. The angle of wrap of at least 60 degrees is essential in order that the compensator arm will properly control the speed of the motor. An angle of wrap greater than about 90 degrees is not desirable in that a larger angle of wrap can adversely impact upon the yarn being processed. For example, brittle fibers such as carbon fibers will have a greater tendency to fracture with an increased angle of wrap or with an increased number of bends.

As used herein, "substantial vertical" means that the angle of wrap around the compensator arm guide roll will be at least about 60 degrees and no more than about 90 degrees. "Angle of wrap" as the term is used herein is the total angle that the yarn strand wraps around a guide roll.

According to the present invention, therefore, a yarn take-up mechanism is provided which utilizes a compensator arm assembly comprising a plurality of compensator arms and guide rolls arranged vertically, preferably above, to a plurality of take-up spindles, with the angle of wrap around the compensator arm guide roll being at least 60 degrees and no greater than 90 degrees, with the total angle of wrap around both the compensator guide roll and spindle guide roll being less than about 180 degrees and preferably less than about 150 degrees, permitting the unit to be very compact and taking up a minimum amount of space within a plant.

DESCRIPTION OF THE PREFERRED EMBODIMENT

Figure 1:
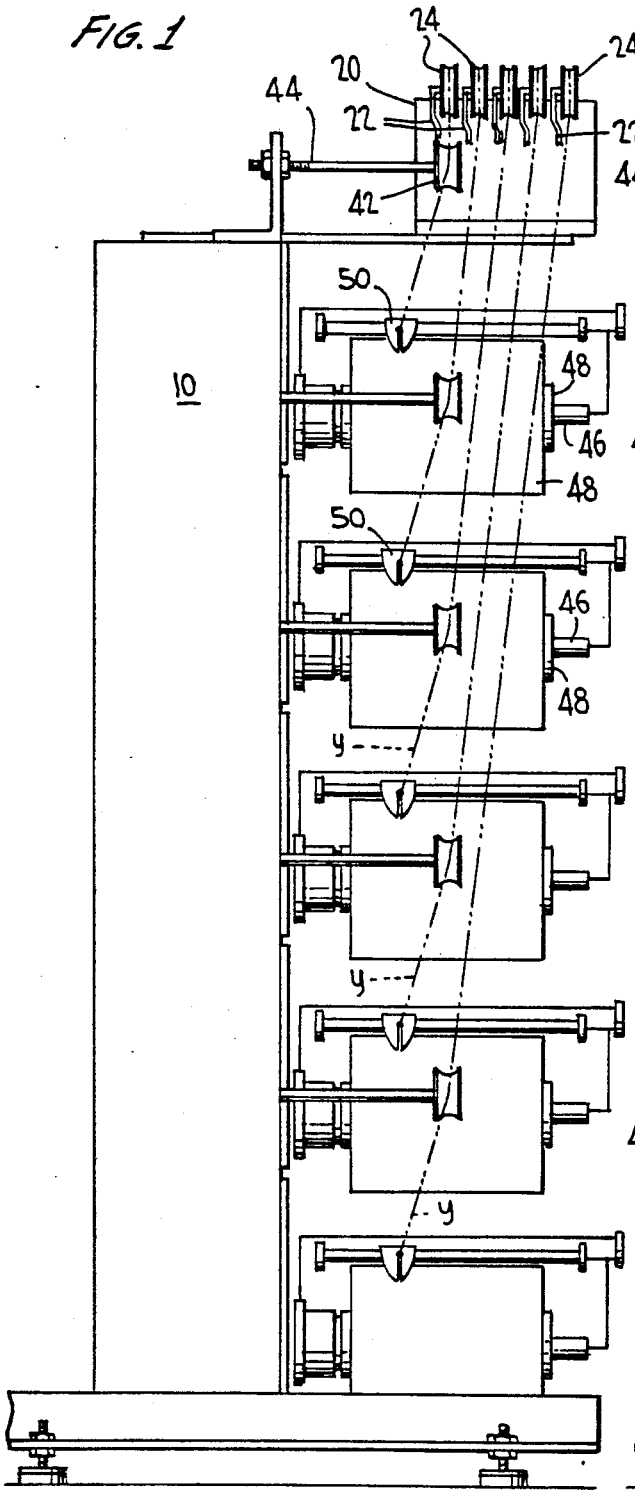
FIG. 1 is a side view of a take-up mechanism according to the present invention wherein the compensator arm assembly is positioned above the take-up spindles arranged in substantial vertical alignment for righthand delivery of a yarn strand.
Figure 2:
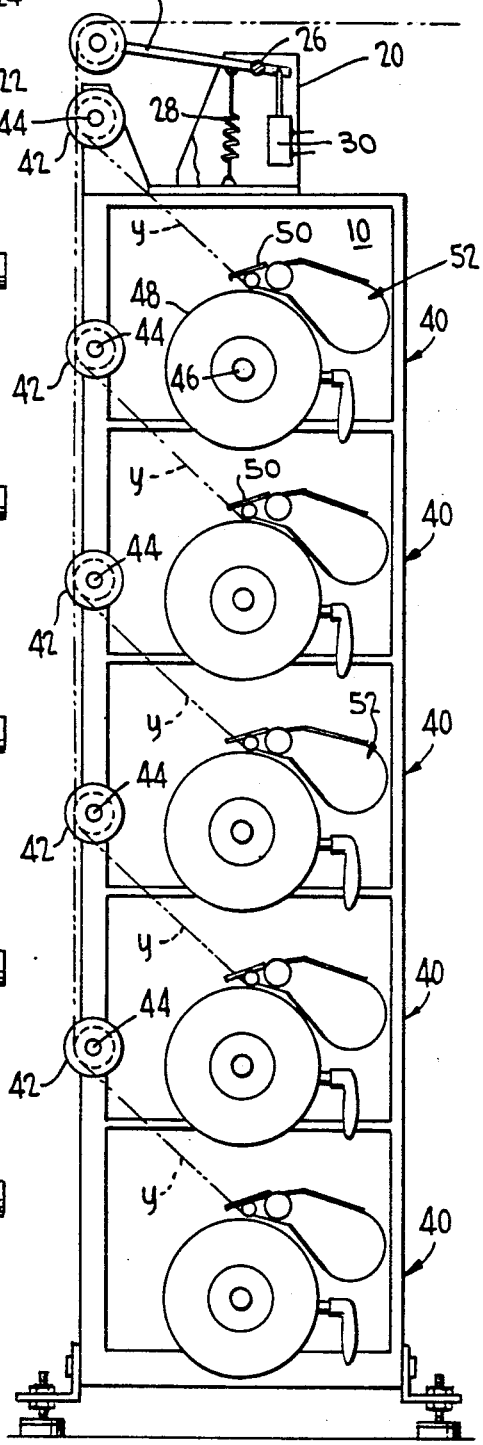
FIG. 2 is a view from the front of the take-up assembly of FIG. 1 with the compensator arm assembly partially broken-away to show the internal mechanism.

Referring to the drawing, in FIGS. 1 and 2 the improved take-up mechanism includes a support unit 10 having a compensator arm assembly 20 positioned above the support unit. The compensator arm assembly comprises five compensator arms 22 each having at one end a guide roll 24. A shaft 26 passes through compensator arm 22 at an end remote from guide roll 24. The position of arm 22 is controllably maintained by adjustable tension spring means 28 which regulates the speed of a variable speed drive electric motor, not shown, through a motion transducer 30 associated with the compensator arm.

Figure 6:
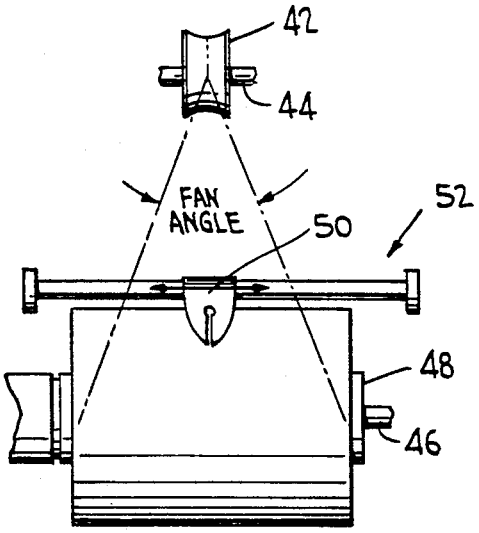
FIG. 6 is a view taken along line 6—6 of FIG. 3 which shows, inter alia, the fan angle of the assembly.

Also mounted on the support unit 10 are five vertically arranged take-up stations 40. Each station includes a guide roll 42 on shaft 44, a spindle 46 which carries a yarn package 48 such as a replaceable spool or tube for receiving yarn Y. Guide rolls 42, as best shown in FIGS. 1 and 6, have a concave surface. Yarn Y is distributed on the yarn package 48 from end to end through guide 50 carried on a yarn traversing mechanism 52 as is conventionally utilized to traverse yarn onto a package.

Figure 3:
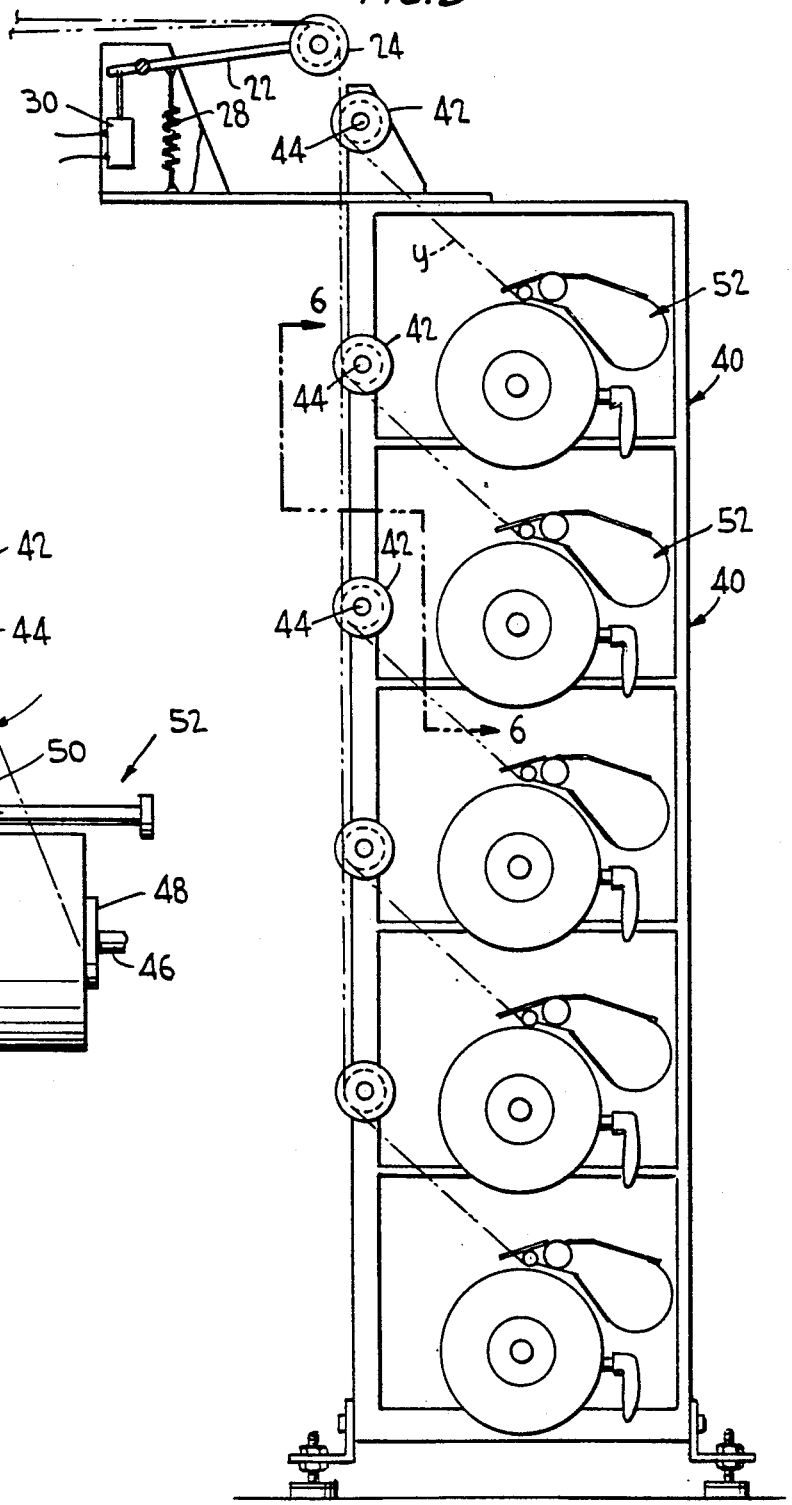
FIG. 3 is a view of an assembly substantially similar to the assembly of FIG. 2 wherein the yarn is delivered from the left side by simply rotating the compensator arm assembly.
Figure 4:
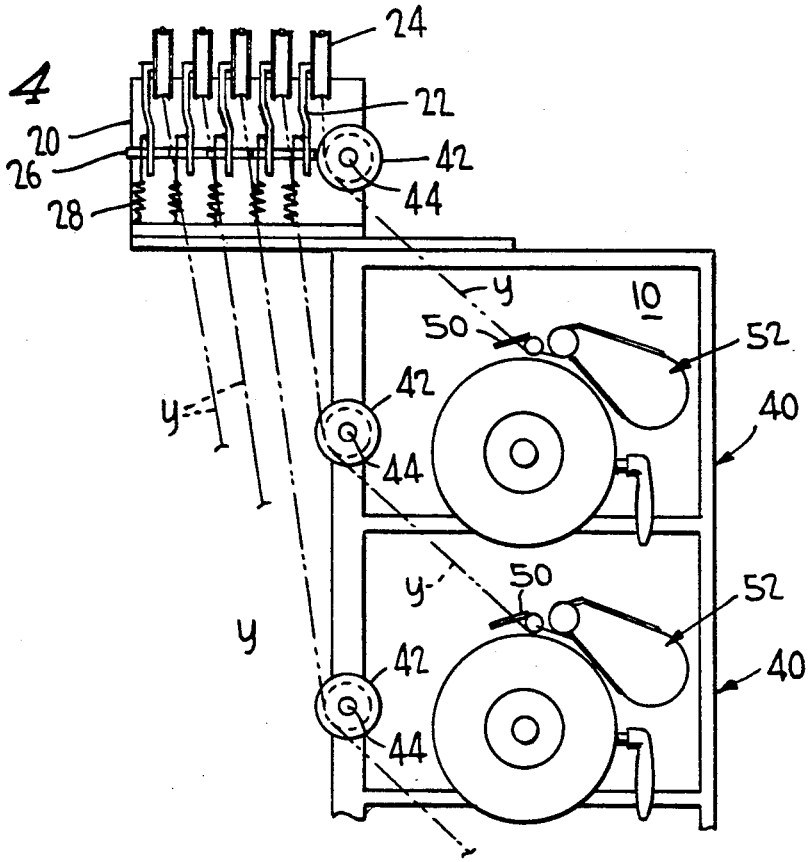
FIG. 4 is a view of an assembly substantially similar to the assembly of FIG. 2 wherein the yarn is delivered from the front.
Figure 5:
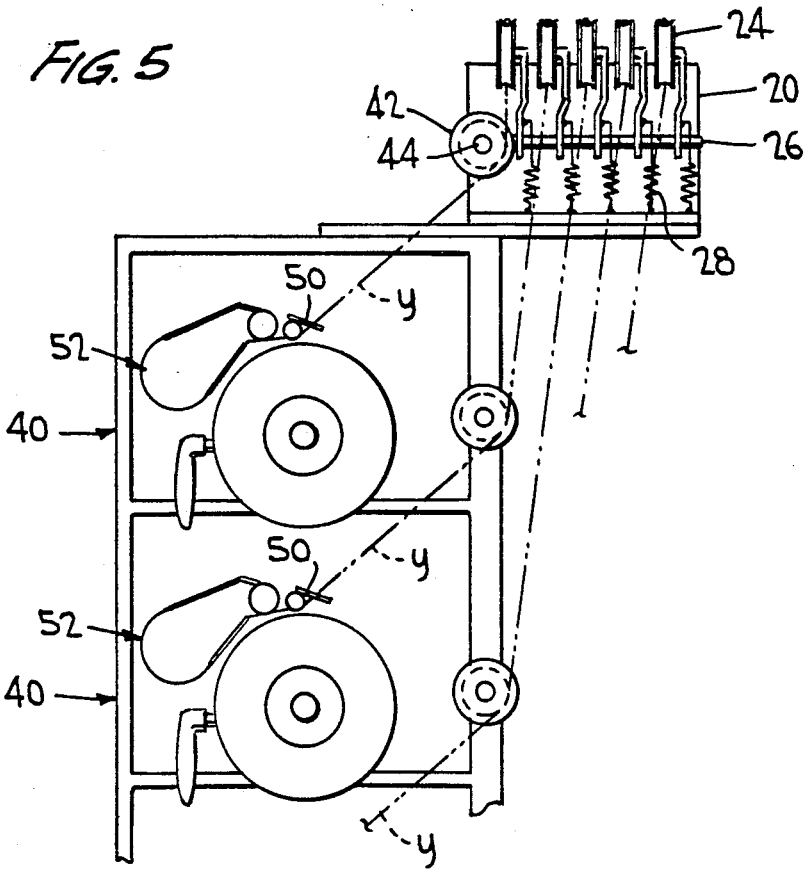
FIG. 5 is a rear view of an assembly substantially similar to the assembly of FIG. 2 wherein the yarn is delivered from the rear.

Whereas in FIGS. 1 and 2 the compensator arm assembly is positioned on support unit 10 directly above the spindles 46 for righthand delivery, in FIG. 3, 4, and 5 the compensator arm assembly is positioned for delivery of the yarn strands to the spindles from the left, or from the front, or from the rear, respectively. As is apparent, with either righthand, lefthand, front, or rear delivery, the fan angle and the total angle of wrap of the yarn strand is the same. However, the ability to deliver yarn from either side or from the front or rear is advantageous in a plant environment.

In operation, a yarn strand Y passes from a delivery source over compensator arm guide roll 24 at an angle of approximately 90 degrees around guide roll 42 at an angle of less than about 60 degrees for a total angle of wrap of less than about 150 degrees for winding on yarn package 48 on spindle 46. As best shown in FIGS. 1 and 4, although the distance between guide roll 42 and yarn guide 50 is no greater than about one and one-half ($1\frac{1}{2}$) times the length of the yarn package, the fan angle still permits traversing of the yarn from one end to the other of the package without undue tension and controlling the rate of delivery. As is apparent, the positioning of the compensator arm assembly substantial vertical to the yarn receiving package, i.e., at an angle of at least 60 degrees of the compensator arm and less than about 90 degrees, permits the construction of a take-up mechanism in a small area without detriment to the yarn winding operation.

The drive mechanism for utilization in the present invention can be used with a conventional yarn receiving system such as a system driven with variable speed DC or AC torque motors.

As will be apparent to one skilled in the art, various modifications can be made within the scope of the aforesaid description. Such modifications being within the ability of one skilled in the art form a part of the present invention and are embraced by the appended claims.

It is claimed:

1. A take-up mechanism for simultaneously winding a plurality of yarn strands on a plurality of take-up spindles comprising (a) support unit;

(b) a plurality of yarn take-up spindles positioned in substantial vertical alignment on said support unit;

(c) drive means constructed and arranged with said plurality of take-up spindles for driving separately each of said plurality of take-up spindles, and (d) a compensator arm assembly positioned above said spindles comprising a plurality of compensator arms pivotable around a common axis and each having a guide roll, said compensator arms of said compensator arm assembly being constructed and arranged to individually control the speed of said drive means for one of said take-up spindles, said plurality in each of said plurality of yarn strands, plurality of take-up spindles, plurality of compensator arms and plurality of compensator arm guide rolls being the same number, with the strand being supplied to and guided by each compensator arm and guide roll to a separate take-up spindle.

* * * * *